US006688141B1

(12) United States Patent
Künzel et al.

(10) Patent No.: US 6,688,141 B1
(45) Date of Patent: Feb. 10, 2004

(54) METHOD AND DEVICE FOR BRAIDING CABLES, CABLE LEADS, AND SHEATHINGS

(75) Inventors: Wolfgang Künzel, Altenburg (DE); Thomas Kutcher, Altenburg (DE); Frank Rattay, Altenburg (DE)

(73) Assignee: CCS Technology, Inc., Wilmington, DE (US)

( * ) Notice: Subject to any disclaimer, the term of this patent is extended or adjusted under 35 U.S.C. 154(b) by 0 days.

(21) Appl. No.: 09/857,720

(22) PCT Filed: Dec. 7, 1999

(86) PCT No.: PCT/DE99/03904

§ 371 (c)(1),
(2), (4) Date: Oct. 26, 2001

(87) PCT Pub. No.: WO00/34561

PCT Pub. Date: Jun. 15, 2000

(30) Foreign Application Priority Data

Dec. 9, 1998 (DE) ..... 198 56 815

(51) Int. Cl.[7] ..... D04B 25/02; D04C 3/40
(52) U.S. Cl. ..... 66/81; 87/6; 87/9; 87/29
(58) Field of Search ..... 66/79, 80, 81, 66/94, 170, 190, 192; 87/3, 6, 7, 8, 9, 12, 24, 29, 30, 33, 48, 53

(56) References Cited

U.S. PATENT DOCUMENTS 2,822,605 A 2/1958 Parlin
4,123,830 A * 11/1978 Matsuda et al. ..... 66/192
4,838,043 A 6/1989 Jencks
5,165,003 A 11/1992 Carter
5,512,709 A * 4/1996 Jencks et al. ..... 66/192
5,603,514 A * 2/1997 Jencks et al. ..... 277/652
6,035,668 A * 3/2000 Akopian ..... 66/81
6,082,144 A * 7/2000 Jencks et al. ..... 66/170

FOREIGN PATENT DOCUMENTS

| | | |
|---|---|---|
| DE | 110 905 | 1/1975 |
| DE | 31 38 491 A1 | 7/1982 |
| DE | 31 13 528 C2 | 10/1982 |
| DE | 195 46 773 A1 | 8/1996 |
| WO | WO 97/41719 A2 | 11/1997 |

OTHER PUBLICATIONS

*Production of Cord and Narrow Fabric Products with Kemafil Technology*, Band–und Flechtindustrie, R. Arnold et al., Jan. 1993, pp. 4–10.

* cited by examiner

*Primary Examiner*—Danny Worrell

(57) ABSTRACT

The invention relates to a method for braiding cables, sheathings or similar workpieces comprising a braided strand chain consisting of a plurality of textile, metallic or similar braided strands, whereby the braided strand chain is produced by using a plurality of gripping elements which manipulate the braided strands. The gripping elements are controlled in such a way that one gripping element takes up the braided strand material of the gripping element positioned in front of the same.

15 Claims, 5 Drawing Sheets

METHOD AND DEVICE FOR BRAIDING CABLES, CABLE LEADS, AND SHEATHINGS

FIELD OF THE INVENTION TUBES

The invention concerns a process and a device for braiding cables, individual cable cores, tubes or similar longitudinal work pieces with several support elements.

BACKGROUND OF THE INVENTION

For the purpose of braiding cables, cable cores, tubes or similar work pieces it is known to use machines and devices, which wind metallic wires, textile fibers or comparable materials, called braided cores or support elements, respectively, around the work pieces to be braided, with the objective of improving their mechanical or physical characteristics such as their stability, resistance to wear or electromagnetic shielding. The individual braided cores are wound around the object to be braided in such a way, that each braided core surrounds the braided object after completed braiding individually.

In order to ensure safe functioning of such braiding, two braided cores are usually provided, where the pitch direction of the spiral lines formed by the braided cores is generally counter rotating to each other.

A sample for a device operating according to this process is described in DE 3113 528 B1.

For special application cases, for example, for electromagnetic shielding of energy conducting cable cores, a multitude of braided cores is used, where each pitch of the spiral line is dimensioned in such a way, that the totality of the braided cores completely covers the jacket surface of the cable to be braided.

The known processes of braided cores being applied around the work piece in a spiral manner function essentially in such a way, that the work piece to be braided is being pulled in a straight line past the point of braiding, and the braided cores used for braiding are moved around the work piece to be braided. The movement of the braided cores around the work piece to be braided is done mainly in a circular way in the plane diagonal to the payoff direction.

In order to achieve the braiding of the braided cores with each other, especially using a multitude of braided cores, complicated motion processes have to be realized, which can only be done with expensive devices. The disadvantage, especially, of this principle of braiding cables, individual cable cores, tubes or similar work pieces, is the fact that the total supply of braiding material has to be constantly moved around the work piece to be braided, in an appropriate storage element such as a spool, in order to achieve the spiral braiding.

Due to the forces resulting from this motion, the volume of braiding material included is limited, since an economical work speed of the machines and devices has to be guaranteed. The volume of included braiding material limited by these reasons determines, on the other hand, the continuous length of the braided work piece which can be manufactured.

A further process for braiding long work pieces with at least one support element is known from DE 195 46 773 A1. The fixing of the support element on the jacket surface of the work piece is achieved by the support element being formed into loops at discrete points of the work piece, which are each pulled together by producing cohesion. This process has the advantage that the supply storage for the support element an be stationary.

In "Herstellung von Kordel-und Banderzeugnissen nach der Kamafiltechnology"; Ing. Rolf Arnold, Ing. Anna-Maria Bartl, Dipl.-Ing. Evelin Huffnagl; pages 4 to 10 of Band-und Flechtindustrie January 1993, published in February 1993 by Melliand Textilberichte GmbH, as well as in DD-A-110 905 mentioned therein, a process in conjunction with a device is described, where a braiding of a longitudinal work piece with exactly four support elements is achieved. The braiding is done, by moving the four gripping devices in such a way, that they can receive the support element of an adjacent gripping device. The movement planes of the gripping devices are parallel to the longitudinal axis of the work piece to be braided.

SUMMARY OF THE INVENTION

The present invention is based on the objective of developing a process and a device which simplify the movement for manipulating at least one such support element in the form of loops.

According to the present invention, to execute braiding of cables, individual cable cores, tubes or similar work pieces at high speeds with simple movement processes of the grips which manipulate the braiding cores, i.e. general manipulation elements.

For manipulation of at least one braiding core, especially in the form of loops and for contracting the same, several grips are preferably provided, whose movement in practice is simpler to synchronize, which requires less mechanical and control expenditure.

An advantageous process is given pursuant to the present invention, according to which the braiding of the work piece with a braided core chain consisting of several braided cores made of textile, metallic and/or similar fibers is done. Each of the braided cores preferably covers that part of the circumference of the work piece which corresponds to the reciprocal value of the braided core number, and preferably wraps around the adjacent braided cores. For example, using 3 braided cores, each braided core would cover approximately one third of the circumference of the work piece.

The braided core chain produced according to the invention is fabricated by using several grips manipulating the braided cores. Each of the grips used is preferably fastened to an oscillating roller with alternating motion.

These oscillating rollers are preferably arranged in such a way, that they have the same distance to each other and that the distance of each oscillating roller to the middle line of the work piece is identical. Each of the grips guides one braided core.

The number of braided cores and therefore the grips manipulating the braided cores is variable and can be adjusted for each application.

The process according to this invention proceeds in such a way that the tip of a first grip moves through a triangle, which is formed from the jacket line of the work piece, the backside of the second grip and the braided core guided by this second grip. Thereby the braided core of the second grip is put around the blade of the first grip. By the movement of the first grip a second triangle is formed, this one formed by the jacket line of the work piece, the backside of the first grip and the braided core guided the first grip. The tip of a third grip moves through this triangle, whereby the braided core of the first grip is put around the blade of the third grip. This third grip, due to its movement, together with the braided core guided by it and the jacket line forms another triangle through which the tip of the second grip moves, whereby the braided core of the third grip is put around the blade of the second grip. With the reverse movement of the grips a relative position to the work piece is achieved, where the braided cores located on the respective grip blade slip from the grip and thus wrap around the braided core of the grip on whose blade they were located.

The chaining of the braided cores according to the invention allows an advantageous braiding of cables, individual cable cores, tubes or similar work pieces at high speeds, where the supply of braiding material is located in a storage element which can be stationary.

BRIEF DESCRIPTION OF THE DRAWINGS

Further advantages and characteristics of the present invention result from the following description of a preferred construction sample, referring to the added diagrams.

Shown is.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
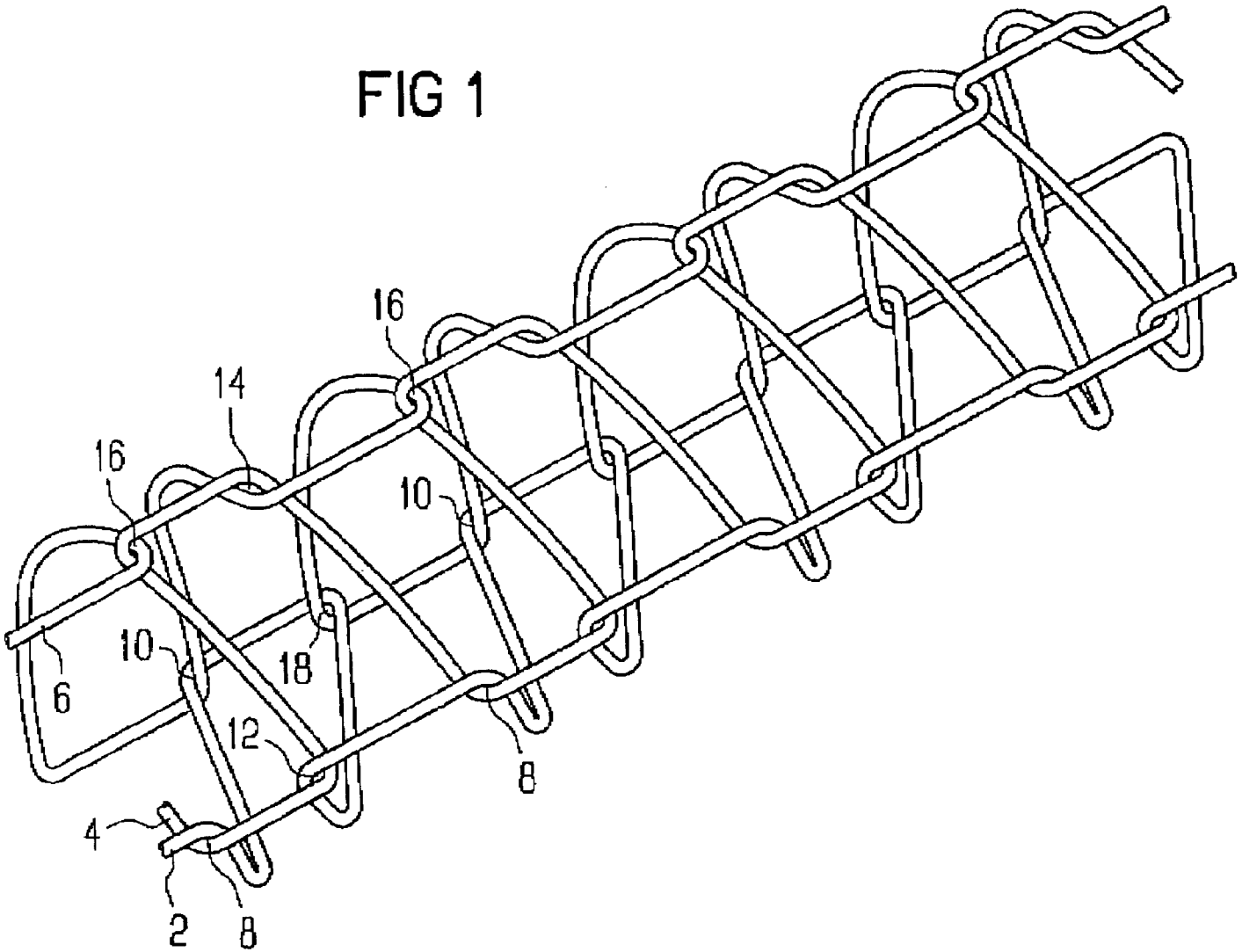
FIG. 1 is a three-dimensional view of a braided core chain consisting of three braided cores surrounding a work piece.

FIG. 1 shows a three-dimensional diagram of a braided core chain formed by three braided cores 2, 4 and 6, where the work piece, which is surrounded by the braided core chain, is not shown in the diagram to make it easily understandable.

As can be seen from FIG. 1, the braided core, or the support element 2, respectively, runs from the first winding point 8 of the braided cores 2 and 4 in a spiral manner around the work piece to the first winding point 10 of the braided cores 2 and 6, while the braided core 4 runs from the first winding point 8 of the braided cores 2 and 4 parallel to the middle line of the work piece to the second winding point 12 of the braided cores 2 and 4. The braided core 6 runs from the first winding point 10 of the braided cores 2 and 6 in a spiral manner on the jacket surface of the work piece to the first winding point 14 of the braided cores 4 and 6, and from there parallel to the middle line of the work piece to the second winding point 16 of the braided cores 4 and 6, and from there again in a spiral manner on the jacket surface of the work piece to the second winding point 18 of the braided cores 2 and 6, and finally from there parallel to the middle line of the work piece to the second winding point 10 of the braided cores 2 and 6, while the braided core 2 runs in a straight line from the first winding point 10 of the braided cores 2 and 6 to the second winding point 18 of the braided cores 2 and 6, from there in a spiral manner on the jacket surface of the work piece to the second winding point 12 of the braided cores 2 and 4, and from there again parallel to the middle line of the work piece to the first winding point 8 of the braided cores 2 and 4. The braided core 4 arrives at the first winding point 8 of the braided cores 2 and 4 in spiral-like direction from the first winding point 14 of the braided cores 4 and 6, after arriving from the second winding point 12 of the braided cores 2 and 4 in a spiral manner at the winding point 16 of the braided cores 4 and 6, and from there finally in parallel direction to the middle line of the work piece to the first winding point 14 of the braided cores 4 and 6.

Figure 2:
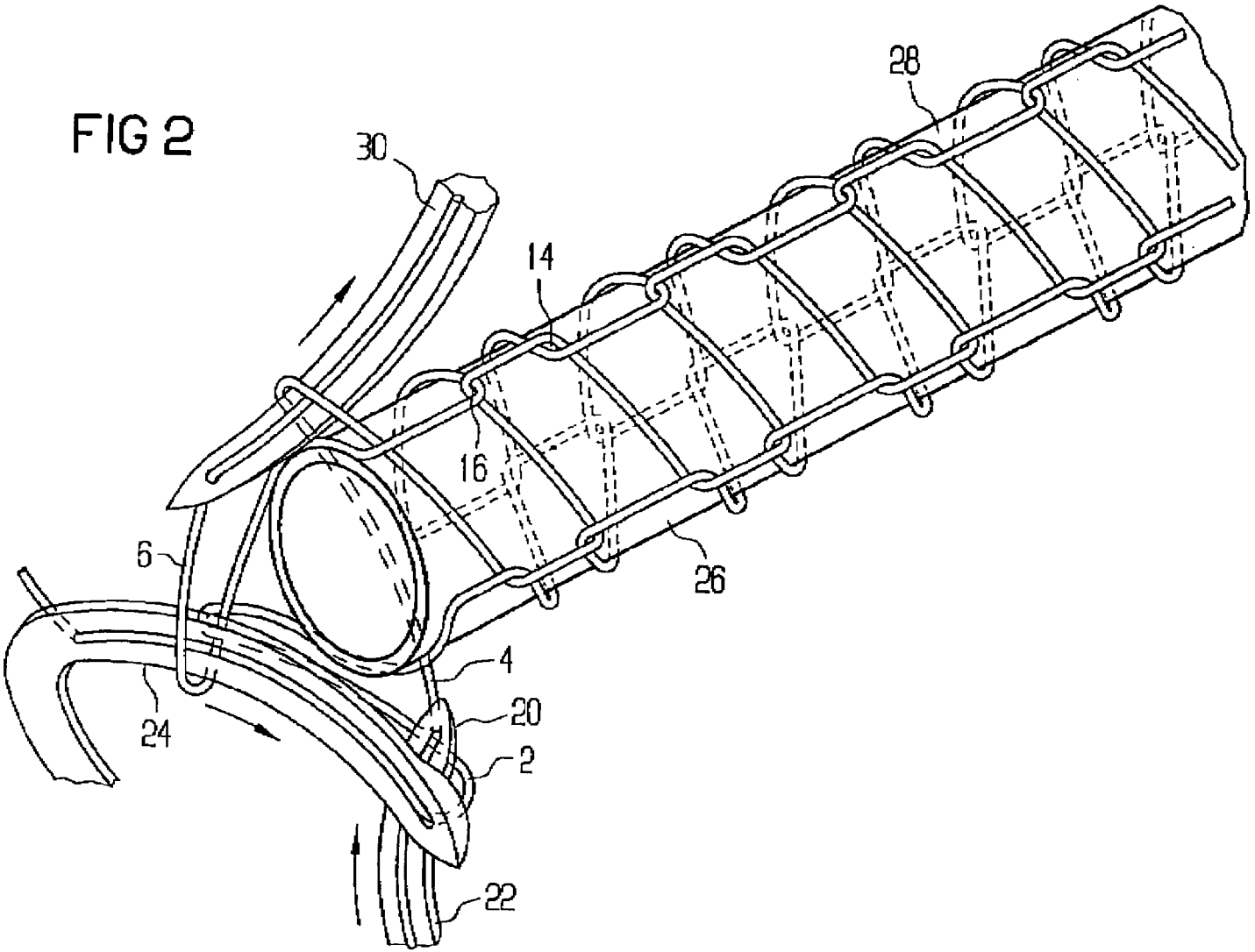
FIG. 2 is a graphic view of the area of the chain formation.

FIG. 2 shows a graphic view in perspective of the area of the braided core chain formation. As can be seen, the tip 20 of the second grip 22 moves through a triangle formed by the first grip 24, the braided core 2 and the jacket line 25 of the work piece 28, and thereby puts the braided core 2 around a blade. The braided core 6 guided by the third grip 30 meanwhile is located around the blade of the first grip 24, while the third grip 30 contains the braided core 4 on its blade, which is guided by the second grip 22. If the third grip 30 continues in its present direction of movement, as shown by the directional arrows, the braided core 4 slides away from this grip and forms two winding points 14 and 16 together with the braided core 6, around which it then winds. In the same manner, the braided cores 2 and 4, as well as the braided cores 2 and 6 form two winding points each per work cycle, after the respective grips release braided cores which they previously took up. The distance of the identical winding points, i.e., the pitch of the braided core chain, is determined by the ratio of the work frequency of the braiding machine to the payoff speed of the work piece.

Figure 3:
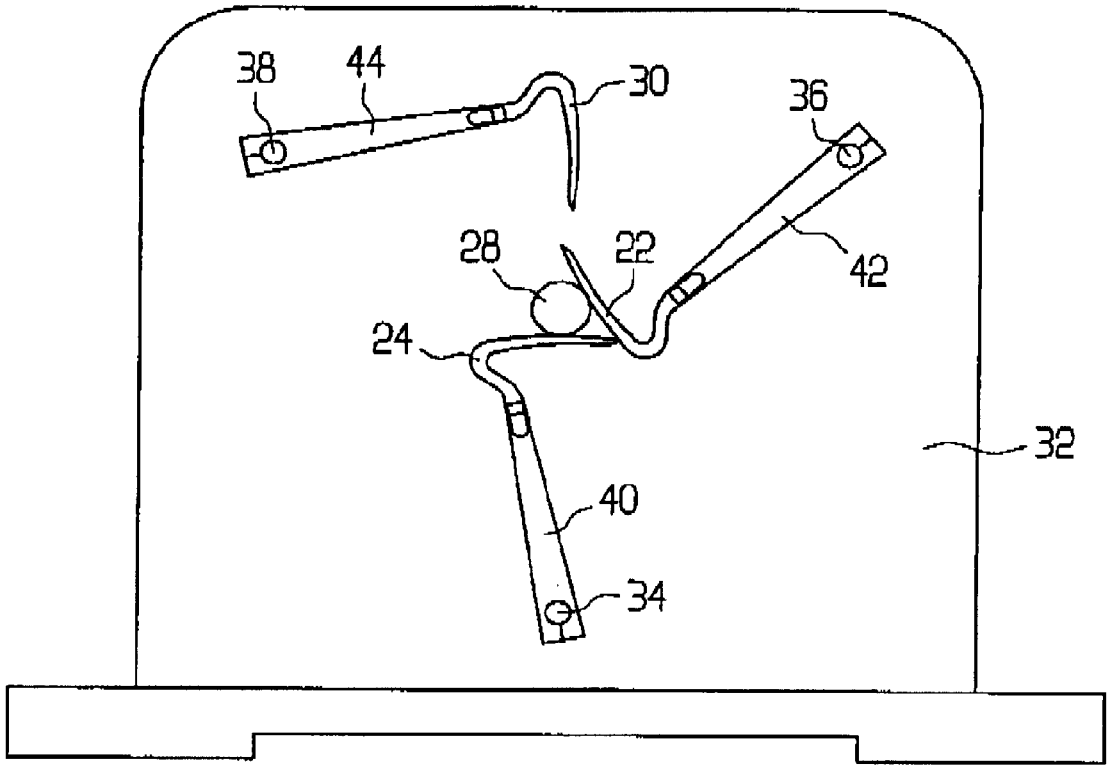
FIG. 3 is a front view of a device for producing a braided core chain consisting of three braided cores according to the process of the invention.
Figure 4A:
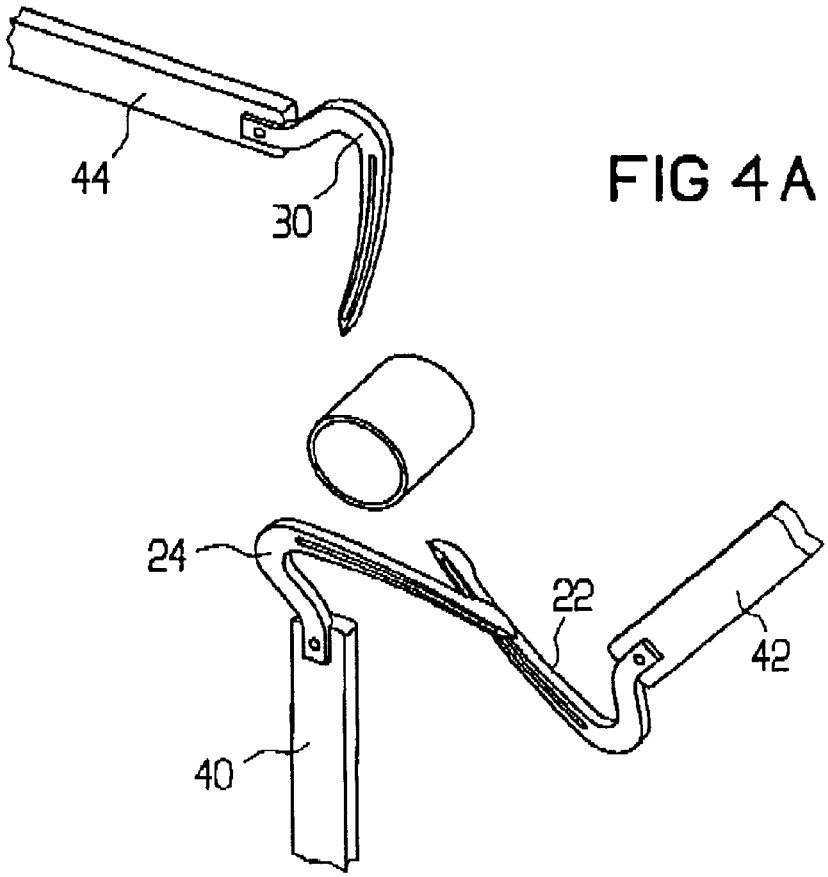
FIGS. 4*a–c* are views of the device shown in FIG. 3, in the area of chain production with the different work positions of the grips.
Figure 4B:
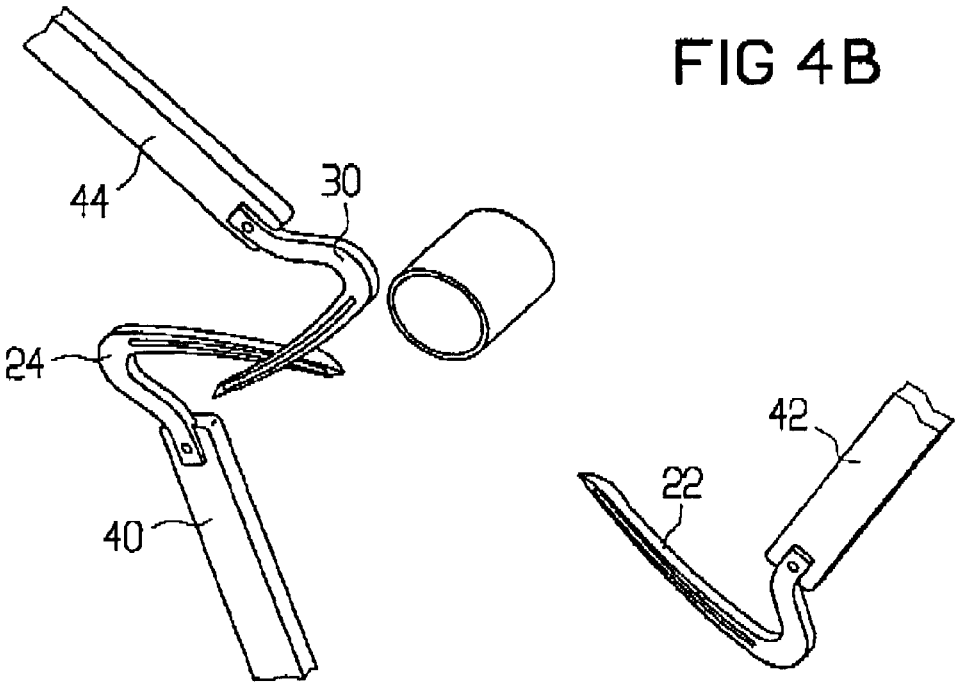
Figure 4C:
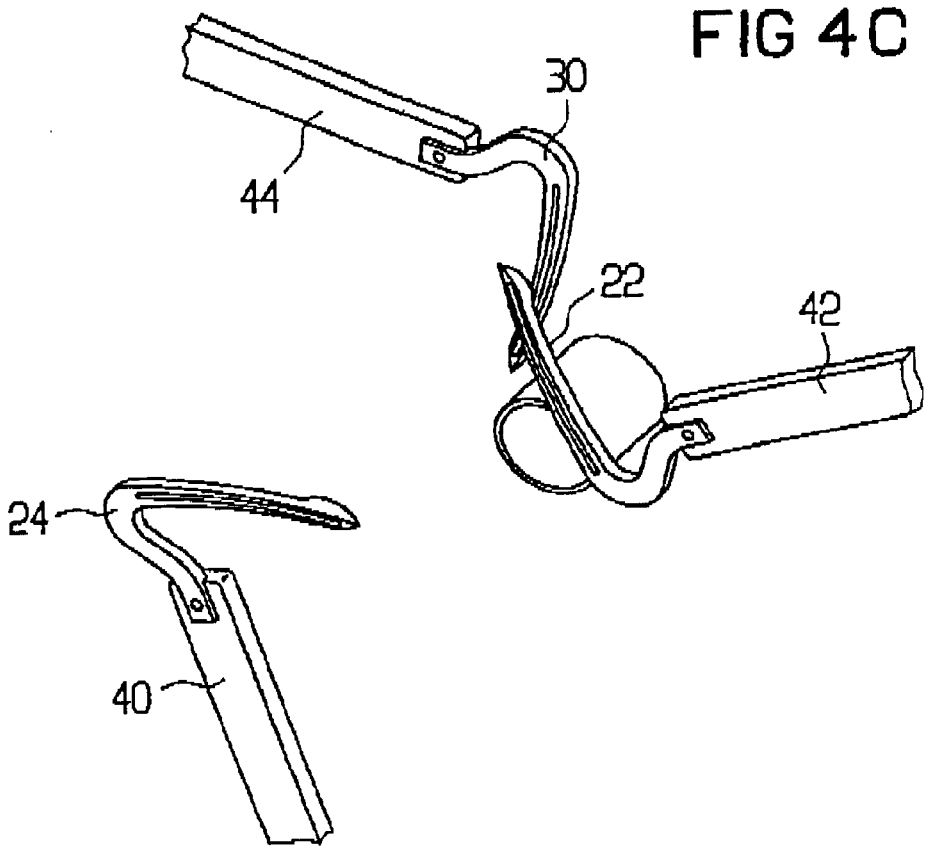

FIG. 3 shows the front view of a preferred construction variable and FIGS. 4*a*–4*c* depict different work positions of the grips of FIG. 3. Three oscillating rollers 34, 36 and 38 are located on a stand 32, which hold the three grip supports 40, 42 and 44. These grip supports 40, 42 and 44 in turn hold the grips 22, 24 and 30. The locating of the oscillating rollers 36 and 38 in the stand 32 is done in such a way, that their longitudinal axes run parallel to the longitudinal axis of the work piece 28. The grip support 44 is arranged in such a way, that the grip 30 moves in a plane which lies immediately behind the plane in which grip 22 moves, seen against the pay-off direction of the work piece 28. This setting is aimed so that the tip of the grip 30 moves securely through the triangle formed by grip 22, the braided core 4 and the jacket line 26 of the work piece, and does not collide with the grip 22 or the braided core 4. The oscillating roller 34 is located in stand 32 in such a way, that its longitudinal axis forms a steep angle with the middle line of the work piece 38. This is done so that the grip 24 is located behind the grip 30 near its left dead point in the payoff direction of the work piece 38, as shown in FIG. 4*b*, so that it, as seen in FIG. 2, can move through the triangle formed by grip 24, the braided core 2 and the jacket line 26 of the work piece 28.

Figure 5:
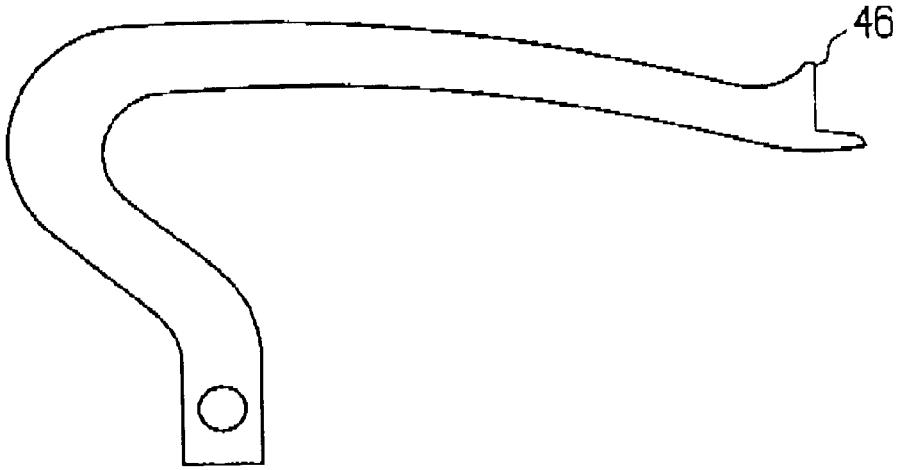
FIG. 5 is a front view of a special grip.

FIG. 5 shows the front view of a grip which is used in a second preferred construction variable.

For this preferred construction variable a braiding of the work piece is done similarly, but only with two braided cores. This grip has a pin point 46 and does not guide its own braided core. At the appropriate point in time, with its pin 46 it takes the braided core of the grip placed in front of it and guides this braided core around the work piece, in order to form a triangle with the braided core and the jacket line 26 of the work piece 28; the grip behind it moves through this triangle and takes up the mentioned braided core. This construction variable has the advantage of using less braided core material for the production of the braided core chain.

Each grip element is preferably formed in the shape of a sickle. In this way each formed loop of each support element can be stored on the grip element, i.e., kept open until threading through of the next loop starting point. This new loop then pulls away the loop on the grip, whereby the loop, due to the sickle-like form of the grip element, can glide to its tip and fall off from there. In this manner, each loop thus formed can be pulled together and tied with the new loop by means of the threading process of the following new loop in combination with the longitudinal payoff movement of the work piece.

Many modifications and other embodiments of the present invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A process for forming a braided core chain about an elongate object that defines a longitudinal axis, the process comprising:

advancing the elongate object in a payoff direction; and manipulating a plurality of braided cores with a plurality of grip elements to form the braided core chain about the elongate object, wherein manipulating the plurality of braided cores comprises controlling the plurality of grip elements such that one grip element engages a braided core carried by another grip element that is forward of the one grip element, against the payoff direction, and further controlling the plurality of grip elements such that each grip element moves in a respective plane that passes through the longitudinal axis defined by the elongate object.

2. The process according to claim 1, wherein the plurality of grip elements comprise at least three grip elements, and wherein controlling the plurality of elements comprises:

moving two of the grip elements within respective planes that are generally parallel to one another; and moving a third grip element within a respective plane that is disposed at a predetermined angle to the respective planes in which the two grip elements move.

3. The process according to claim 1, wherein the plurality of grip elements comprise at least three grip elements, and wherein controlling the plurality of grip elements comprises:

moving two of the grip elements within respective planes that are generally perpendicular to the longitudinal axis defined by the elongate object; and moving a third grip element within a respective plane that is disposed at a predetermined angle to the longitudinal axis defined by the elongate object.

4. The process according to claim 1, wherein controlling the plurality of grip elements comprises:

moving a tip of a first grip element through a triangle formed by a jacket line of the elongate object, a second grip element and the braided core guided by the second grip element such that the braided core guided by the second grip element is placed around a blade of the first grip element;

moving a tip of a third grip element through a second triangle formed by the movement of the first grip element and defined by the jacket line of the elongate object, the first grip element and the braided core guided by the first grip element such that the braided core guided by the first grip element is placed around a blade of the third grip element; and moving a tip of the second grip element through a third triangle formed by the movement of the third grip element and defined by the jacket line of the elongate object, the third grip element and the braided core guided by the third grip element such that the braided core guided by the third grip element is placed around a blade of the second grip element, wherein movement of the grip elements causes the braided cores placed on the blade of each grip element to glide off of the grip element and therefore wind around the braided core guided by the respective grip element.

5. The process according to claim 1, wherein manipulating the plurality of braided cores further comprises winding each braided core about that portion of the circumference of the object corresponding to about the reciprocal of the number of braided cores.

6. The process according to claim 1, wherein manipulating the plurality of braided cores further comprises winding each braided core around the other braided cores.

7. The process according to claim 1, wherein the plurality of braided cores comprises two braided cores, and wherein controlling the plurality of grip elements comprises passing a braided core from one grip element to another grip element by means of a pin point on at least one of the grip elements.

8. A device for forming a braided core chain about an elongate object that defines a longitudinal axis and that is advanced in a payoff direction, the device comprising:

a stand; and a plurality of grip elements mounted upon the stand for manipulating a plurality of braided cores thereby forming the braided core chain about the elongate object, wherein the grip elements are displaced in the payoff direction such that one grip element engages a braided core carried by another grip element that is forward of the one grip element against the payoff direction, and wherein each grip element moves in a respective plane that passes through the longitudinal axis defined by the elongate object.

9. The device according to claim 8, further comprising a plurality of oscillating rollers mounted to the stand for carrying respective grip elements and permitting movement of the grip elements relative to the stand.

10. The device according to claim 9, wherein the plurality of grip elements comprises at least three grip elements and the plurality of oscillating rollers comprises at least three oscillating rollers.

11. The device according to claim 8, wherein each oscillating roller defines a longitudinal axis, and wherein two of the oscillating rollers are mounted to the stand such their respective longitudinal axes are parallel to the longitudinal axis of the elongate object, and another oscillating roller is mounted to the stand such that its longitudinal axis defines a predetermined angle with respect to the longitudinal axis of the elongate object.

12. The device according to claim 8, wherein at least one grip element includes a pin pivot.

13. The device according to claim 8, wherein the plurality of oscillating rollers have alternating movement.

14. The device according to claim 8, wherein the plurality of oscillating rollers are mounted to the stand such that the distance between each oscillating roller is about equal and such that the distance between each oscillating roller and the longitudinal axis of the elongate object is about equal.

15. The device according to claim 8, wherein each grip element has a sickle-like shape.

* * * * *